US011015361B2

(12) United States Patent
Baik

(10) Patent No.: US 11,015,361 B2
(45) Date of Patent: May 25, 2021

(54) MULTILAYERED MECHANICAL PARKING SYSTEM

(75) Inventor: Yunkang Baik, Seoul (KR)

(73) Assignee: Yoonkang Baek, Seoul (KR)

( * ) Notice: Subject to any disclaimer, the term of this patent is extended or adjusted under 35 U.S.C. 154(b) by 0 days.

(21) Appl. No.: 13/143,087

(22) PCT Filed: Oct. 28, 2009

(86) PCT No.: PCT/KR2009/006251

§ 371 (c)(1),
(2), (4) Date: Jun. 30, 2011

(87) PCT Pub. No.: WO2010/076964

PCT Pub. Date: Jul. 8, 2010

(65) Prior Publication Data

US 2011/0268539 A1 Nov. 3, 2011

(30) Foreign Application Priority Data

Dec. 30, 2008 (KR) ..... 10-2008-0136500
Jul. 22, 2009 (KR) ..... 10-2009-0066993

(51) Int. Cl.
*E04H 6/20* (2006.01)
*E04H 6/22* (2006.01)

(52) U.S. Cl.
CPC ..... *E04H 6/22* (2013.01)

(58) Field of Classification Search
CPC ..... E04H 6/14; E04H 6/20
USPC ..... 414/227, 331, 235
See application file for complete search history.

(56) References Cited

U.S. PATENT DOCUMENTS

| | | | | | |
|---|---|---|---|---|---|
| 2,656,940 | A * | 10/1953 | Sumners et al. | 414/257 |
| 2,899,086 | A * | 8/1959 | Thaon De Saint-Andre | 414/232 |
| 3,088,605 | A * | 5/1963 | Martinson | 414/231 |
| 3,944,085 | A * | 3/1976 | Obregon | 414/231 |
| 3,984,012 | A * | 10/1976 | Ennis et al. | 414/231 |
| 4,950,117 | A * | 8/1990 | Go | 414/254 |
| 5,118,239 | A * | 6/1992 | Morioka | 414/235 |
| 2009/0081010 | A1* | 3/2009 | Jayasuriya | 414/227 |

FOREIGN PATENT DOCUMENTS

| | | |
|---|---|---|
| JP | 07-269150 | 10/1995 |
| JP | 2004-060156 | 2/2004 |
| KR | 10-2000-0062044 | 10/2000 |
| KR | 10-0403484 | 10/2003 |
| KR | 10-2005-0021067 | 3/2005 |

OTHER PUBLICATIONS

International Search Report for PCT/KR2009/006251 dated Jul. 1, 2010.

* cited by examiner

*Primary Examiner* — Jonathan Snelting
(74) *Attorney, Agent, or Firm* — IPLA P.A.

(57) ABSTRACT

The present invention relates to a parking system which separates storage and delivery parts of vehicles to be parked, and separately operates an vertical moving part moving up and down and vertically and horizontally moves the vehicle which has been stored in a prompt and efficient manner.

7 Claims, 9 Drawing Sheets

MULTILAYERED MECHANICAL PARKING SYSTEM

RELATED APPLICATIONS

This application is a 371 application of International Application No. PCT/KR2009/006251, filed Oct. 28, 2009, which in turn claims priority from Korean Patent Application Nos. 10-2009-0066993, filed Jul. 22, 2009, and 10-2008-0136500, filed Dec. 30, 2008 each of which is incorporated herein by reference in its entirety.

TECHNICAL FIELD

The present invention relates to multilayered mechanical parking systems.

Specifically, the present invention relates to a parking system which separates storage and delivery parts of vehicles to be parked, and separately operates an vertical moving part moving up and down and vertically and horizontally moves the vehicle which has been stored in a prompt and efficient manner.

BACKGROUND ART

The present inventor's Patent No. 10-0403484 discloses as follows:

A multilayered parking system comprises a power generating unit which is installed in an upper end part of a central moving path A formed in the parking system including a multilayered left and right moving path by horizontal and vertical members and is connected to a vehicle transportation device to supply power at all times by transferring the generated power to a main driving shaft extending to the lowest end of the central moving path and a towing driving shaft arranged horizontally in an upper lateral surface of the central moving path; a clutch device which is engaged with the main driving shaft connected to the power generating unit and controls the power supply to left and right conveyor belts by an internal controller; a vehicle transportation device which has a timing device, etc. provided in a lower part thereof and devices provided in an upper surface thereof to elevate and tow vehicles; and a left and right vehicle loading part which has a conveyor belt device receiving power from the main driving shaft by the operation of the clutch device and operating like a caterpillar when the vehicle transportation device arrives at a predetermined floor.

In the power generating unit, a first power generating unit 501 and a second power generating unit 502 are installed to face each other in left and right sides of an upper end of a vertical member 500 including the central moving path A to vertically move the vehicle transportation device, and a power transferring means 504 connected to a first output shaft 503 of the first power generating unit 501 is connected to a gear 505 installed in a top end of the main driving shaft 506 to drive the main driving shaft 506 and concurrently drive a towing pole 509 by the power supplied by the second output shaft 507 through the second power transferring means 508, and the power from the second power generating unit 502 is used to drive a second towing pole 512 facing the towing pole 509 by a third power transferring means 511.

The vehicle transportation device moves up and down by the power supplied by the power generating unit and has the main driving shaft 506 penetrating a lateral part of the vehicle transportation device and changes its direction by a power transforming means 550 to thereby move the loaded vehicle to the left and right horizontal moving paths B and C, and enables a gear clutch 553 connected to a front end of a control lever 552 operated by a solenoid device 551 to receive the transformed power, and is engaged with and moves together with the left and right transportation of the gear clutch 553 and enables a sleeve yoke to be connected to a sleeve joint 554 formed in a second end thereof.

Also, the vehicle transportation device includes a clutch structure wherein a conic insertion body 556 has a plurality of tools 557 in a base thereof and an inclusion part is spaced from the clutch structure in a front end of the sleeve yoke 555 to include the insertion body therein.

In the left and right vehicle loading part, curves 701 are consecutively arranged in parallel in an upper surface of an upper structure shaped like a rectangular parallelepiped and a lower part thereof has a space. A lower structure which is shaped like a rectangular parallelepiped symmetrical to the upper structure and has an upper part open has a plurality of vertical walls 704 installed alternately in left and right ends thereof and a connection part 703 with a hollow part 707 among the vertical walls 704, and forms a roller retainer 705 in a lower surface of the lower structure to install roller members 706 and forms a filling layer 710 by filling the space formed by the connection of the upper and lower structures with an elastic material.

The present inventor invented a parking tower system with the above features.

Vehicles may be moved up and down and left and right sides by using the power generating units 501 and 502 which are the feature of the foregoing system. However, as the system should supply and transform power as a single configuration, such system becomes complicated with an accompanying elevator, left and right transformation parts and complicated power transformers and power transferring devices. The complicated system leads to a complicated control system to thereby cause considerable maintenance expenses.

To solve the foregoing problem, the present inventor discloses a parking system with a separate unit by separating a storage part and a delivery part and enabling elevation of parked vehicles in Korean Patent Application No. 10-2008-136500. The parking system with the foregoing structure does not need a pallet for parking vehicles in a required spot and enables separate storage and delivery of vehicles, and the processing rate of such system is two times or more faster than conventional mechanical parking systems.

BRIEF SUMMARY

The present invention has been made to solve the problems and it is an object of the present invention to provide a parking system, which is easy to install and maintain and changes in structure even after installation.

Another aspect of the present invention is to provide a parking system which enables a user to install a mechanical parking lot customized for the parking volume and site as a single-unit system is manufactured, investigated and tested at a factory before delivery.

The present invention relates to a multilayered parking system which improves and embodies the present inventor's prior patent application no. 10-2008-136500.

To provide a parking system by compartmentalization according to the present invention, a conveyor belt which is used to move vehicles is formed by assembly, and a power generating unit and a power transforming unit are manufactured as a single unit.

The present invention provides a mechanical clutch device in which an operation of left and right conveyor belts does not malfunction.

The present invention provides a parking system by compartmentalization and enables an installation of a parking system with many floors.

The present invention includes a device storing and delivering a vehicle at the same time, a device moving a vehicle horizontally and controllers controlling the foregoing devices, both of which operate correlatively. Accordingly, a vehicle is loaded on a single moving pallet and is parked in a target spot from storage to delivery, and minimizes time and power taken for the storage and delivery of the vehicle due to the operation of loading and moving another vehicle for delivery.

As a storage and delivery controller and a storage and delivery moving part are formed as a single unit, they operate separately. A storage and delivery parking unit is fixed and installed in left and right sides. Accordingly, only the storage and delivery controller and the storage and delivery moving part move and operate to store and delivery a vehicle and store and delivery many vehicles within short time.

The effect of the present invention will be described by claim in more detail.

According to claim 1 of the present invention, a parking unit which comprises a storage part and a delivery part in the left and right sides thereof is installed, and a storage and delivery moving part is installed therebetween and operates by the delivery and storage controller to thereby deliver a vehicle in the first side and store another vehicle in the second side and enable a prompt delivery and storage of vehicles.

According to claim 2 of the present invention, a concurrent function of storage and delivery is performed by a storage and delivery parking unit, together with a parking function. A multilayer structure is available by out frames 520 and 620 to voluntarily increase or decrease the number of parking vehicles according to the parking lot condition and amend a delivery part and a storage part depending on the parking status.

According to claim 3 of the present invention, transmission/suspension of driving power, change of direction and moving distance and speed of the entire conveyor belt is controlled with respect to the storage and delivery controller and left and right storage and delivery parking unit.

According to claims 4 to 6 of the present invention, a power transmission to and a direction of the conveyor belt is voluntarily controlled by an operation of a lever controlling operation of the storage and delivery and a cylinder.

According to claim 7 of the present invention, combination of upper and lower units of the conveyor belts enables high productivity and less wear and tear and efficient operation. In particular, the units have bending structures and may move small to large vehicles without any amendment.

According to the present invention, an accurate parking location may be identified by a stopper notwithstanding a difference of size among small and large vehicles.

DETAILED DESCRIPTION

The present invention provides a parking system which has a multilayered, horizontal, vertical circulation mechanical parking system by compartmentalization and easy to assemble and maintain at the site.

The present invention provides a transportation structure by compartmentalization which includes a storage and delivery moving part 1500 receiving power from a delivery and storage controller 1000 and left and right clutches 301 and 302 by the delivery and storage controller 1000 and moves a parking vehicle from a delivery and storage parking unit to the left and right sides. Further, the present invention includes the delivery and storage parking unit which moves vehicles from the left and right sides of the delivery and storage controller and the delivery and storage moving part to the left and right sides of the vehicles to perform the delivery and storage operations separately. Further, the present invention provides the delivery and storage parking unit and the moving structure in a unit to thereby extend or reduce the size and type of a parking lot.

Hereinafter, exemplary embodiments of the present invention are described with reference to accompanying drawings.

Figure 1:
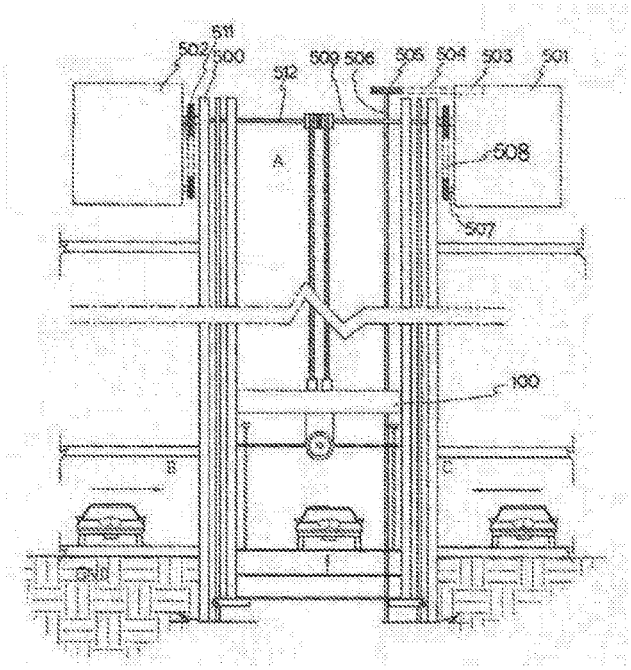
FIG. 1 Prior Art
FIGS. 1 to 3 illustrate a prior patent of the present inventor.
Figure 2:
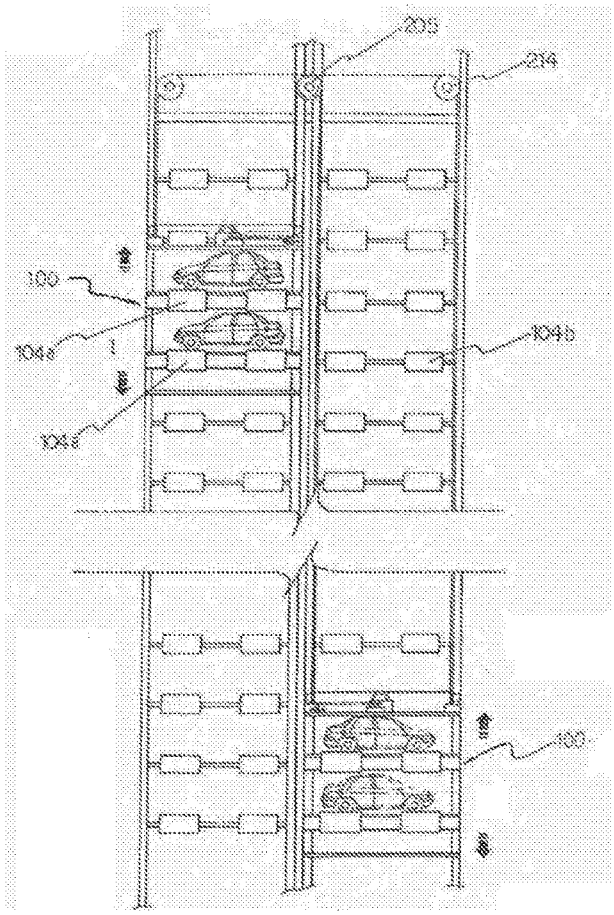
FIG. 2 Prior Art
Figure 3:
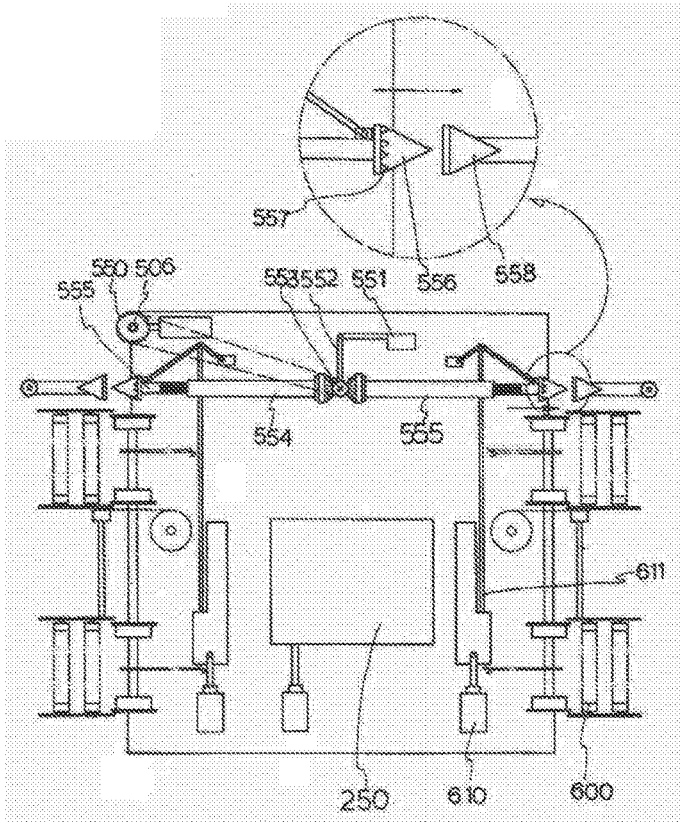
FIG. 3 Prior Art
Figure 4:
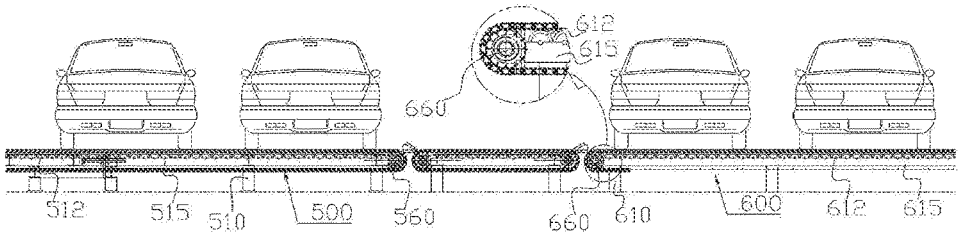
FIG. 4 is a front view of the entire configuration of the present invention.
Figure 5:
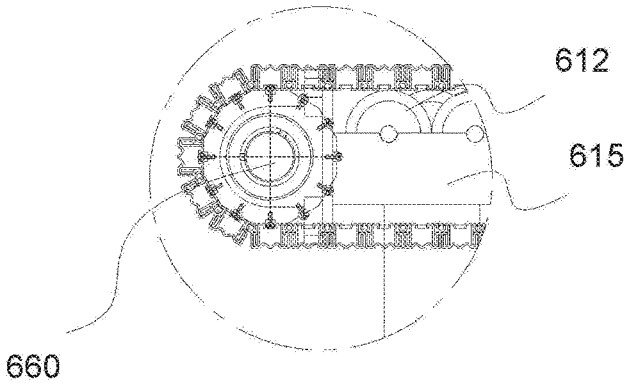
FIG. 5 is a partial enlarged front view of a conveyor belt, a driving sprocket and a slider connected to one another.
Figure 6:
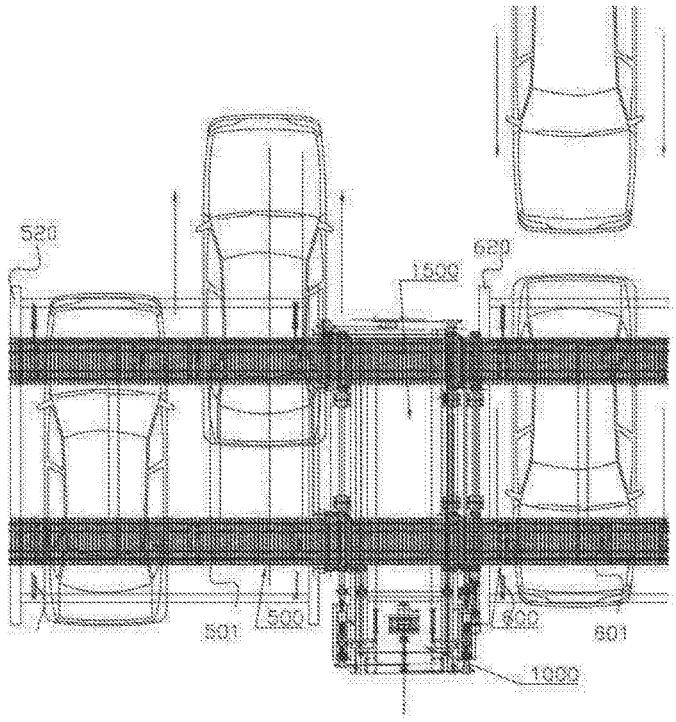
FIG. 6 is a plan view of the entire configuration of the present invention.
Figure 7:
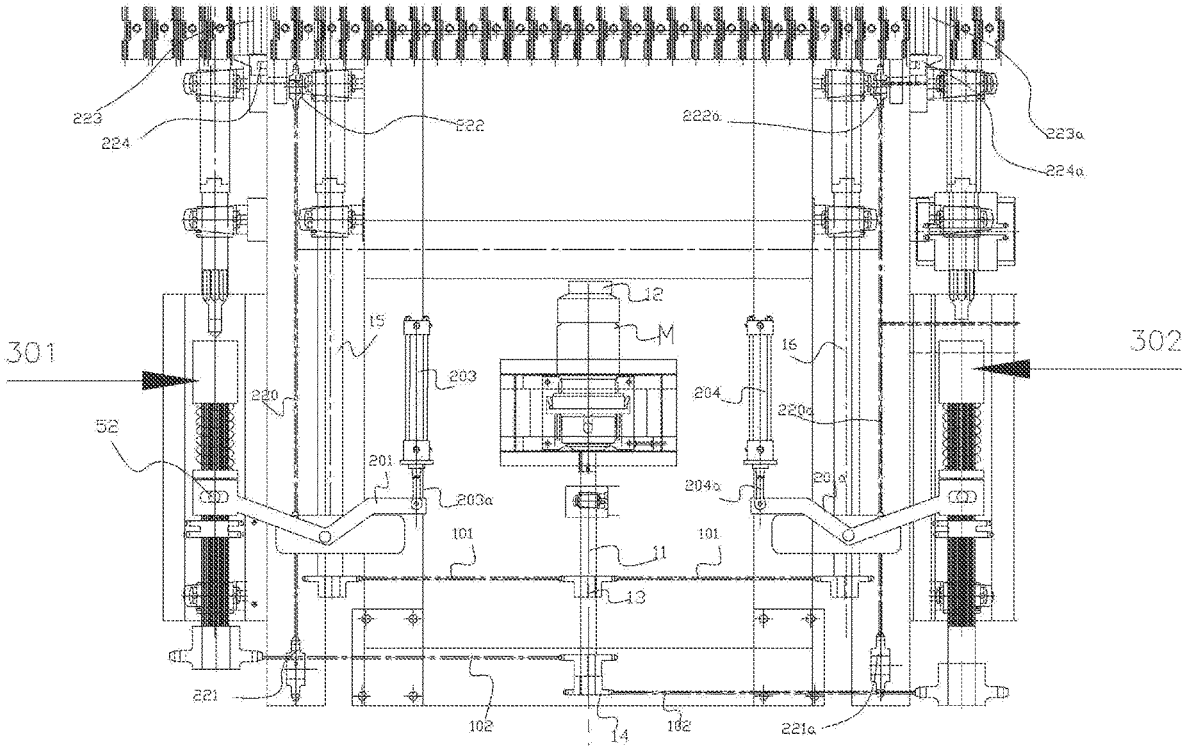
FIG. 7 is a plan view of a delivery and storage controller according to the present invention.
Figure 8:
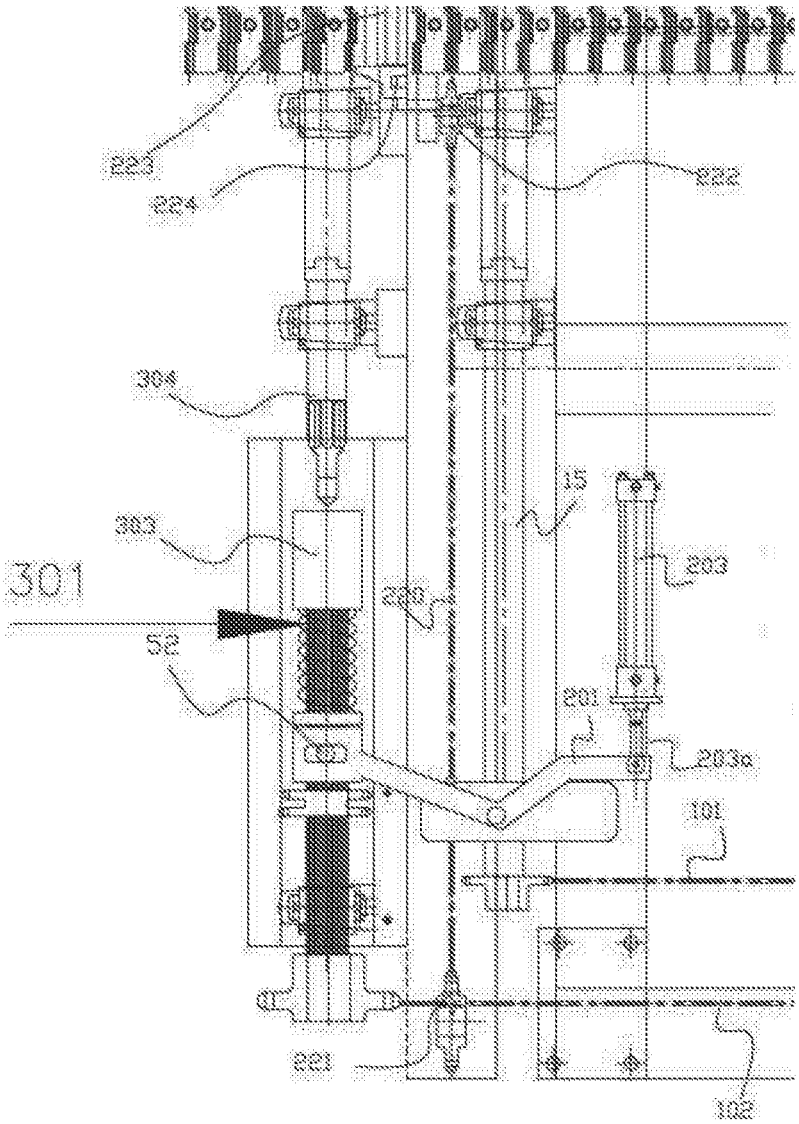
FIG. 8 is an enlarged plan view of the delivery and storage controller according to the present invention.
Figure 9:
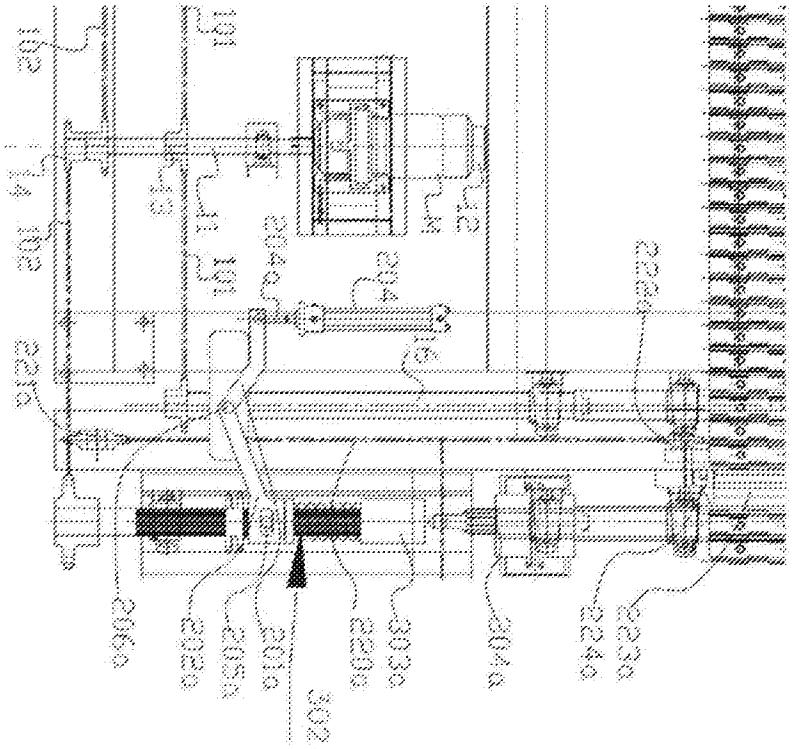
FIG. 9 is an enlarged plan view of the delivery and storage controller according to the present invention.
Figure 10:
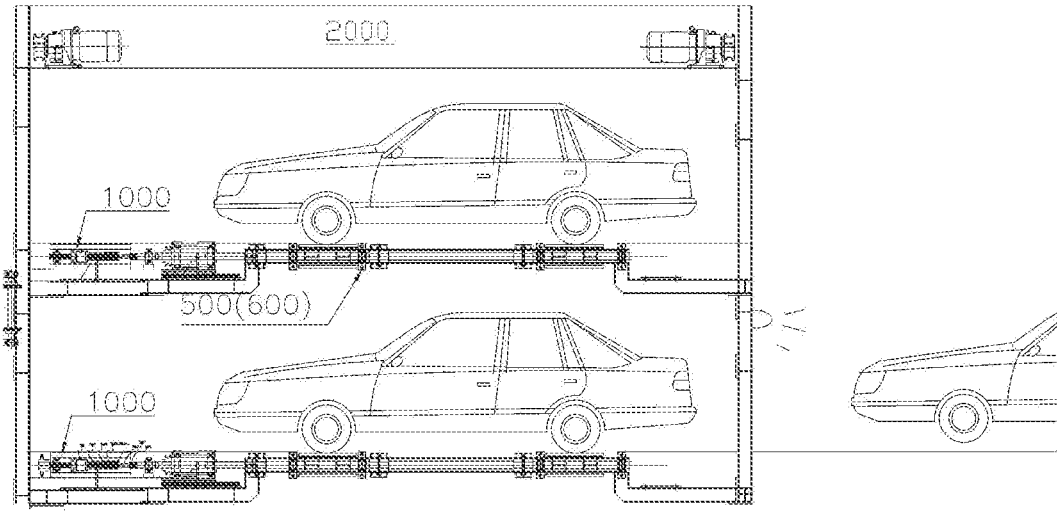
FIG. 10 illustrates the delivery and storage controller and a delivery and storage moving part according to the present invention.
Figure 11:
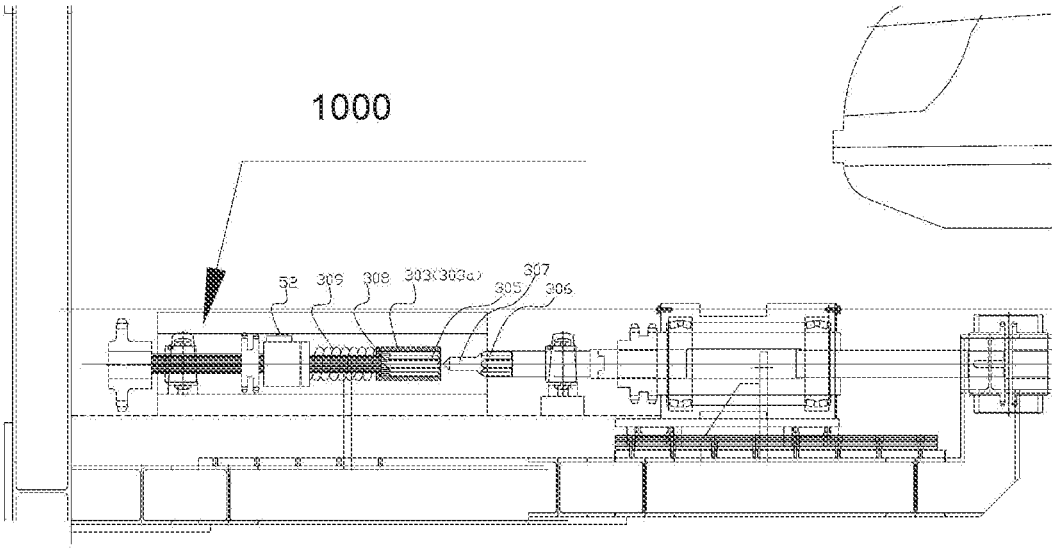
FIG. 11 is a partial enlarged view of a clutch of the installation state in FIG. 10.
Figure 12:
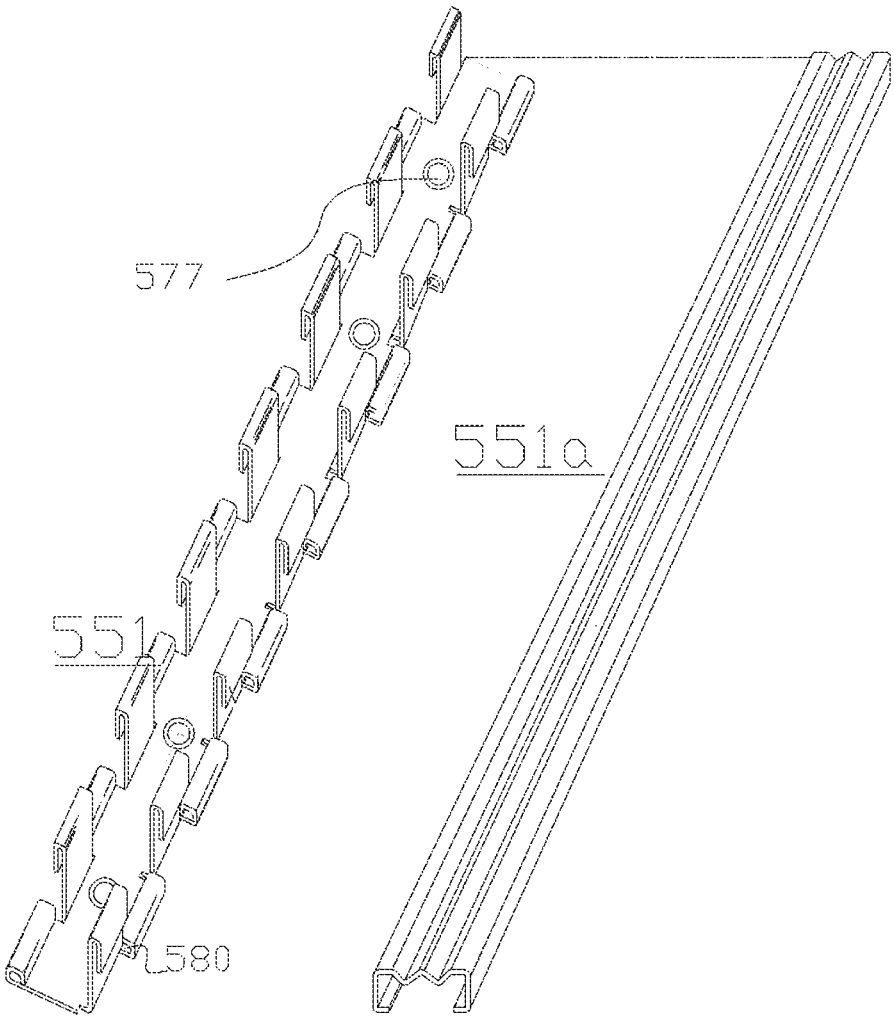
FIG. 12 is an exploded perspective view of a conveyor belt unit according to the present invention.
Figure 13:
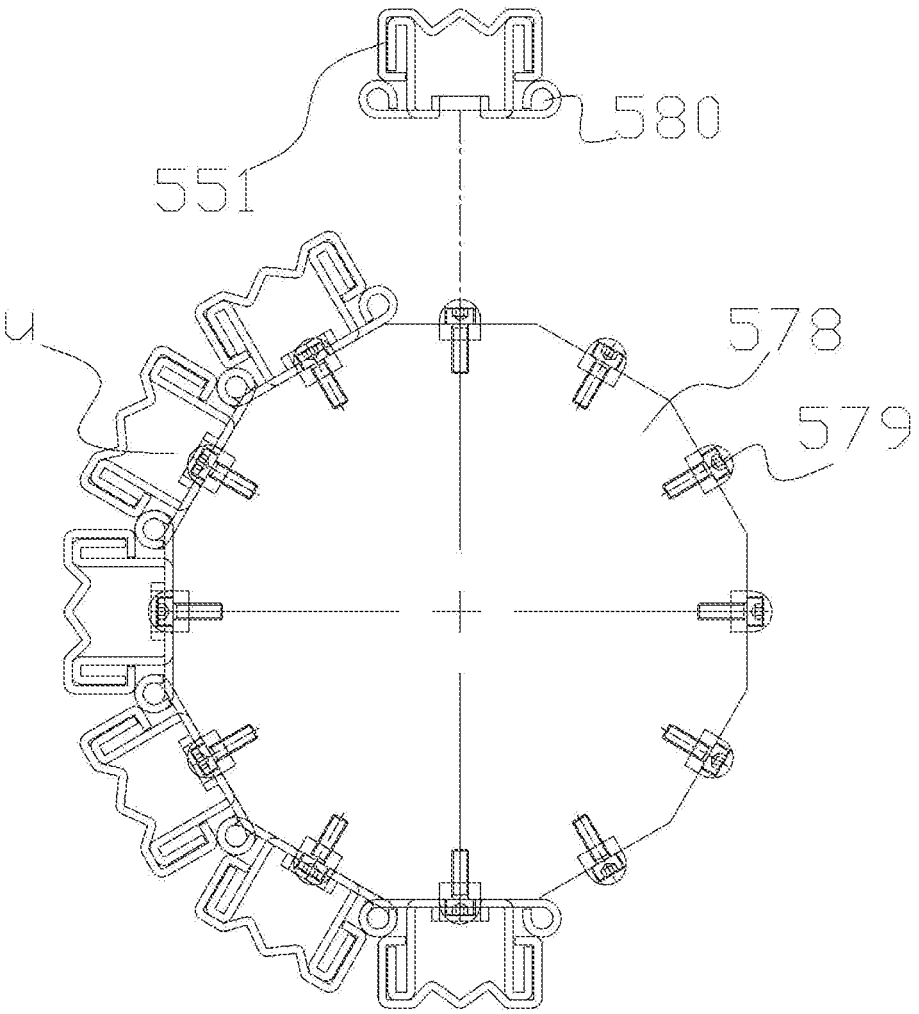
FIG. 13 is a partial enlarged front view of the conveyor belt and the driving sprocket according to the present invention.
Figure 14:
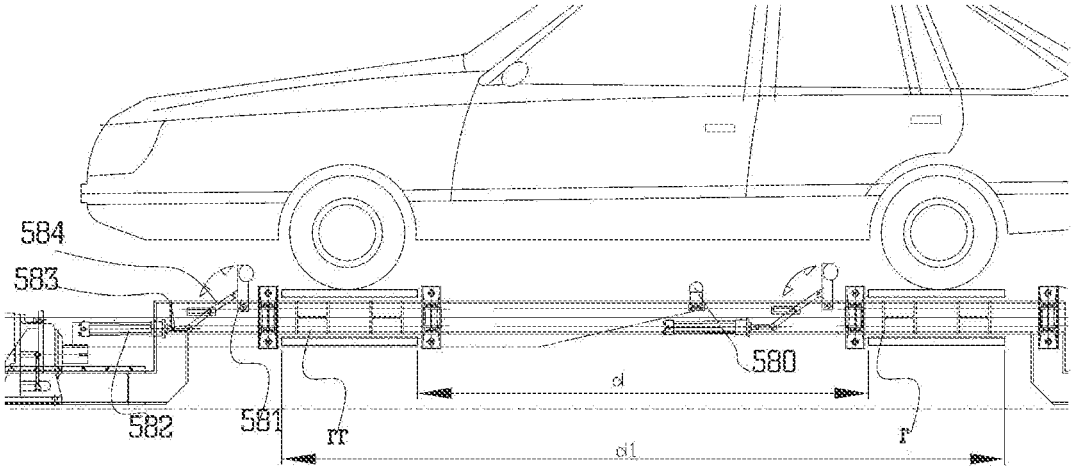
FIG. 14 is a lateral view of a stopper which automatically controls a parking location of each vehicle according to the present invention.
Figure 15:
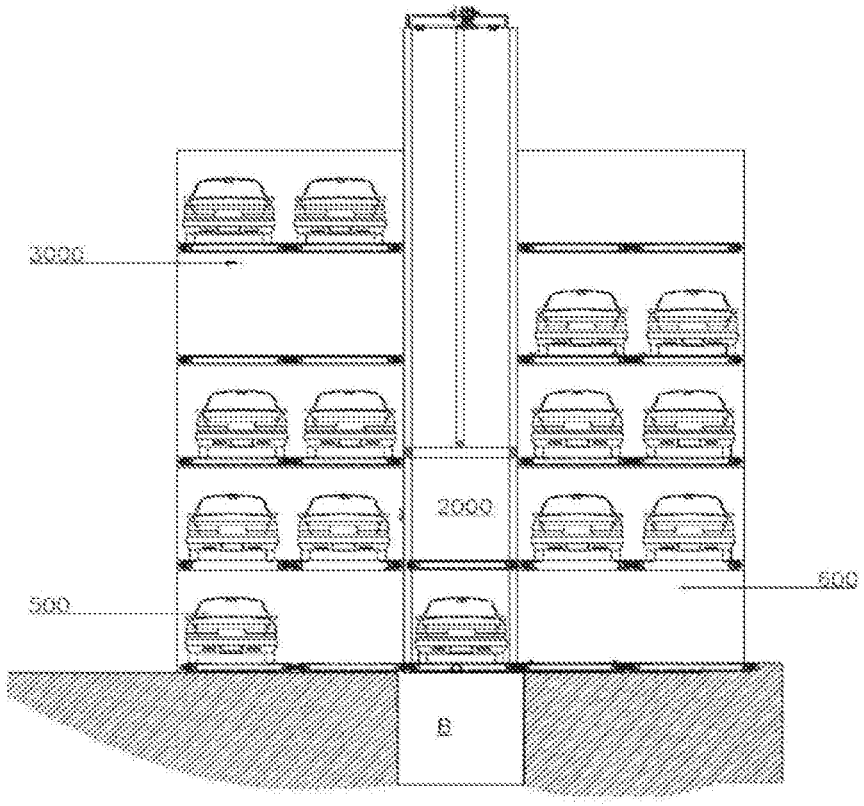
FIG. 15 is a front view of a parking state according to the present invention.

FIG. 4 is a front view of the entire configuration of the present invention. FIG. 5 is a partial enlarged front view of a conveyor belt, a driving sprocket and a slider according to the present invention. FIG. 6 is a plan view of a delivery and storage state of vehicles according to the present invention. FIG. 7 is a front view of the delivery and storage controller according to the present invention. FIG. 8 is an enlarged plan view of the delivery and storage controller according to the present invention. FIG. 9 is an enlarged plan view of the delivery and storage controller according to the present invention. FIG. 10 is a lateral view of the delivery and storage controller and a delivery and storage moving part according to the present invention. FIG. 11 is a partial enlarged view of a clutch in FIG. 10. FIG. 12 is an exploded perspective view of the conveyor belt unit according to the present invention. FIG. 13 is a partial enlarged front view of the conveyor belt and the driving sprocket according to the present invention. FIG. 14 is a lateral view of a stopper which automatically controls the parking location of each vehicle type according to the preset invention. FIG. 15 is a front view of the installation state.

As shown in FIGS. 4 to 6, a multilayered, mechanical parking system includes a power generating unit which supplies power to the parking system having a left and right moving path by horizontal and vertical members, a clutch device which controls the power supply to left and right conveyor belt by an internal controller, a vehicle moving device which includes devices to move vehicles up and down like an elevator and moves vehicles horizontally like a conveyor belt with respect to a timing device, a storage part and a moving part and a delivery part, and a controller to control the foregoing devices.

Left and right guide frames 515 and 615 are installed in front/rear of left and right supporting frames 510 and 610 formed by front and rear and left and right members. Left and right sliders 512 and 612 are arranged in the guide frames 515 and 615. Upper ends of the sliders 512 and 612 directly contact an external lower surface of a lower unit 551 of a left and right conveyor belt. The left and right conveyor belt which contacts the sliders move in a caterpillar type by the movement of the left and right driving sprockets 560 and 660.

The delivery and storage controller 1000 is arranged in a center of the delivery and storage parking unit and controls the power input/output of the power transmission device to move the vehicle, which has been moved by the delivery and storage parking unit, to the left and right sides, and controls a rotation direction, speed and distance of the conveyor belts 501, 601 and 1501 of the left and right conveyor belts and the delivery and storage moving part.

The delivery and storage moving part 1500 receives power from the left and right clutches 301 and 302 by the delivery and storage controller and moves the vehicle from the delivery and storage parking unit to the left and right sides.

The multilayered, mechanical parking system further includes an elevation device 2000 to move the delivery and storage controller and the delivery and storage moving part up and down.

According to the present invention, the left and right supporting frames or the left and right guide frames are not specifically limited to certain frames as long as they employ a structure steel such as H beam to support vehicles and control devices.

According to the present invention, the rotation of the conveyor belt of the delivery and storage parking unit installed in the left and right sides is performed by the power supplied by the left and right clutches 301 and 302.

The multilayered delivery and storage parking units 500 and 600 are driven by an out frame 520 extending from left and right guides frames 515 and 615 in front/rear of the left and right supporting frames 510 and 610 formed by the front and rear and left and right members. FIG. 15 is a front view of the actual parking state according to the present invention, wherein the delivery and storage parking unit is arranged in the left and right sides and the elevation device 2000 is installed in the center to move vehicles up and down. The elevation device 2000 is formed in two layers to perform the delivery and storage functions at the same time. Accordingly, an underground part B is installed in the center where the elevation device 2000 is installed, and a lower layer of the two-layer elevation device may enter the underground. The parking device with the foregoing configuration may be consecutively arranged vertically and horizontally to thereby increase/decrease the number of vehicles to be parked. The delivery and storage parking units 500 and 600, which contact the ground, should be vacant always for the delivery and storage of vehicles. A vehicle loading part 3000 is installed in an upper part of the delivery and storage parking units 500 and 600 to load vehicles. In a lower part of the vehicle loading part 3000, vehicles which are loaded to the left and right conveyor belts 501 and 601 rotating in a caterpillar type by the rotation of the left and right driving sprockets 560 and 660 may move to the left and right side.

According to the present invention, the core controller which controls loading and unloading of vehicles in the multilayered parking system includes the power generating unit which generates power by a driving motor M in a center and outputs the power to an output shaft 11 and a rotation detector 12 in a rear of the driving motor M.

First gears 13 are installed in the output shaft 11 of the power generating unit to transform and transfer the power to the conveyor belt for the delivery and storage controller, and second gears 14 supplies the power to the left and right conveyor belts.

The first gears 13 are connected to the driving shafts 15 and 16 for the delivery and storage controller installed in the left and right sides by the power transferring means 101 to transfer power. The second gears 14 are connected to the left and right clutches 301 and 302 through the left and right transferring means 102 to transfer power to the left and right conveyor belt.

The control tool includes left and right levers 201 and 202 to transfer power from the power transferring means to the left and right driving sprockets 560 and 660 and left and right hydropneumatic cylinders 203 and 204 to control operations of the levers 201 and 202.

In the case of the control tool, the left and right levers 201 and 201*a* connected to operating rods 203*a* and 204*a* of the left and right hydropneumatic cylinders 203 and 204 enable the shift forks 205 and 205*a* connected to the front ends 202 and 202*a* of the operating lever to move back and forth toward the left and right conveyor belt driving shafts by the movement of the operating rods 203*a* and 204*a*, centering on the pins 206 and 206*a*.

According to the present invention, a space is formed between the central loading part and the left and right conveyor belt when a vehicle is moved to the left or right side or delivered. To prevent a lower wheel of the vehicle from being stuck in the space, a central part of the left and right levers 201 and 201*a* connected to the operating rods 203*a* and 204*a* of the left and right hydropneumatic cylinders 203 and 204 is connected to a first end of the left and right timing belts 220 and 220*a*, and a second end of the timing belts 220 and 220*a* is connected to left and right shift levers 224 and 224*a* of left and right interlocking belts 223 and 223*a* through left and right idle gears 221 and 221*a* and 222 and 222*a*.

The left and right clutches 301 and 302 according to the present invention receive power when acceptance gears 303 and 303*a* and synchronizers 304 and 304*a*, which are hollow and are shaped like a cylinder, are associated with each other.

Internal screw grooves 305 of the acceptance gears 303 and 303*a* are engaged with external screw threads 306 of the synchronizers 304 and 304*a*. From a front end of the synchronizers 304 and 304*a*, a centering shaft 307 projects. The internal lateral part 308 of the acceptance gears 303 and 303*a* are elastically supported by a spring 309 and may move back and forth by the back and forth movement of the shift fork. Thus, the power supply to the left and right side is in line with the advancement of the vehicle.

The present invention is further characterized by the left and right delivery and storage parking part and the delivery and storage moving part. As shown in FIG. 12, conveyor units u which are formed by lower unit 551 and upper unit 551*a* engaged to each other are arranged in a caterpillar type by being consecutively connected by a pin hole 580. A coupling hole 577 is formed in the conveyor units u.

A driving pin 579 of a conveyor driving roller 578 is inserted into the coupling hole 577 to move a vehicle loaded onto the conveyor, by a rotation of the conveyor driving roller 578.

As shown in FIG. 14, the present invention is characterized by an installation of a vehicle entering detection switch 580 between a front conveyor belt r and a rear conveyor belt rr. If a vehicle enters, the vehicle entering detection switch 580 detects a pressure of wheels of the vehicle and transfers a detection signal to a main controller. Such signal is an operating signal with respect to the hydropneumatic cylinder 582 for the stopper 581 installed in the front and rear conveyor belts r and rr to vertically project to operate the operating rod 583 and a link piece 584 connected to the operating rod 583 and to vertically and horizontally move the stopper 581.

A distance d between the front and rear conveyor belts r and rr is 10 to 20% larger than the wheel base of a small car. A distance dl between the front conveyor belt r and an external end of the rear conveyor belt rr is 10 to 20% larger than the wheel base of a large vehicle. Thus, any vehicle can be parked regardless of its size.

More specifically, the present invention is further characterized by a difference of a wheel base, which is 2 or 3 m from small vehicles to large vehicles to park vehicles by type. The present invention has a width of the front conveyor belt and the rear conveyor belt larger to accommodate various types of vehicles, in which case a difference of the wheel base is 1 m or more and waste of space occurs.

According to the present invention, the vehicle entering detector is provided between the front conveyor belt and the rear conveyor belt, and a distance d between the front and rear conveyor belts is 10 to 20% larger than the wheel base of a small car, whose wheel base is shortest among all vehicles. A distance dl between the external ends of the front and rear conveyor belts is 10 to 20% larger than the wheel base of a large vehicle whose wheel base is the largest.

With the foregoing configuration, the present invention may park cars from the smallest wheel base to the largest wheel base to thereby meet the demand for parking various types of vehicles.

INDUSTRIAL APPLICABILITY

The present invention may install a mechanical parking lot to park the desired number of vehicles in a small area.

Accordingly, the parking lot may be installed in a conventional building without any amendment to structure.

Also, even if large mechanical parking lots have already been installed, the unit parking lot according to the present invention may be applicable to a parking system which is not operated due to technical or mechanical problems or whose operation has been suspended due to maintenance issues.

The invention claimed is:

1. A multilayered mechanical parking system, comprising:

storage and delivery parking units comprising left and right guide frames respectively installed in front and rear of left and right supporting frames formed by front and rear and left and right members; left and right sliders arranged in the guide frames respectively, wherein upper ends of the sliders are arranged to directly contact an external lower surface of a lower unit of left and right conveyor belts, wherein the left and right conveyor belts are configured to rotate in a caterpillar manner by a rotation of left and right driving sprockets;

a storage and delivery moving unit;

a storage and delivery controller arranged in a central part of the storage and delivery parking units and being configured to control power input and output of a power transferring unit to move a vehicle from the storage and delivery parking units to left and right sides and to control a rotation direction, speed and rotation distance of the left and right conveyor belts and conveyor belts of the storage and delivery moving unit, wherein the storage and delivery moving unit is configured to receive power from left and right clutches of the storage and delivery controller; and an elevation unit configured to move up and down the storage and delivery controller and the storage and delivery moving unit.

2. The parking system according to claim 1, further comprising:

a power generating unit having a driving motor provided in a front central area thereof to generate power and output such power to an output shaft; and a first gear and a second gear being installed in the output shaft of the power generating unit, wherein the first gear is configured to transform and transfer power from the output shaft of the power generating unit to a conveyor belt for the storage and delivery controller and the second gear is configured to transfer power to the left and right conveyor belts, wherein the first gear is connected to driving shafts, for the storage and delivery controller via a power transferring component, and right power transferring components to transfer power to the left and right conveyor belts; and a control tool comprising left and right levers to transfer power from left and right power transferring units to the left and right driving sprockets and left and right hydropneumatic cylinders configured to control an operation of the left and right levers.

3. The parking system according to claim 2, wherein the control tool further comprises left and right shift forks that are connected to front ends of the left and right levers, and wherein the left and right levers are connect to operating rods of the left and right hydropneumatic cylinders and enable the left and right shift forks to move back and forth with respect to left and right conveyor belt driving shafts.

4. The parking system according to claim 3, further comprising left and right timing belts, wherein a first end of the left and right timing belts is connected to a central part of the left and right levers, and a second end of the timing belts is connected to left and right shift levers of left and right interlocking belts.

5. The parking system according to claim 3, wherein the left and right clutches are configured to transfer power when acceptance gears are engaged with synchronizers, wherein each of the acceptance gears is hollow and cylindrical shaped, wherein internal screw grooves of the acceptance gears are engaged with external screw threads of the synchronizers, wherein a centering shaft projects from a front end of the synchronizers, and wherein an internal rear surface of the acceptance gears is elastically supported by a spring and moves horizontally by a horizontal movement of the shift forks.

6. The parking system according to claim 1, wherein each conveyor belt comprises conveyor belt units that are consecutively connected by pin holes in a caterpillar manner, as a lower unit and upper unit which have concave and convex parts are connected to each other, wherein a coupling hole is formed in each of the conveyor belt units, and a driving pin of a conveyor driving roller is inserted into the coupling hole to operate by a rotation of the conveyor driving roller.

7. The parking system according to claim 1, wherein a vehicle entrance detecting switch is installed between a front conveyor belt and a rear conveyor belt in the storage and delivery parking units and detects a pressure of wheels of the vehicle and transmits a signal to a main controller, wherein a vertical and horizontal movement of a stopper is performed by an operating rod and a link piece connected to the operating rod by an operating signal with respect to a hydropneumatic cylinder for the stopper installed in the front and rear conveyor belts to project vertically, wherein a distance between the front and rear conveyor belts is 10 to 20% larger than a wheel base of the vehicle, and wherein a distance between external ends of the front and rear conveyor belts is 10 to 20% larger than a wheel base of the vehicle.

* * * * *